United States Patent [19]

Tien

[11] Patent Number: 4,646,594

[45] Date of Patent: Mar. 3, 1987

[54] WRENCH SOCKET

[76] Inventor: Kuang-Yung Tien, 3063 Via Del Sol., San Jose, Calif. 95132

[21] Appl. No.: 638,952

[22] Filed: Aug. 8, 1984

[51] Int. Cl.[4] ..... B25B 13/06

[52] U.S. Cl. ..... 81/121.1

[58] Field of Search ..... 81/119, 120, 121.1, 81/186, 177.85, 185

[56] References Cited

U.S. PATENT DOCUMENTS 838,109 12/1906 Hanes et al. ..... 81/61

FOREIGN PATENT DOCUMENTS 210221 7/1960 Fed. Rep. of Germany ..... 81/121.1

*Primary Examiner*—Frederick R. Schmidt
*Assistant Examiner*—Debra S. Meislin
*Attorney, Agent, or Firm*—Holman & Stern

[57] ABSTRACT

A wrench for square and hexagonal nut fasteners having a peripherally closed socket defined by eight notches of right angles for reception of the driving head, the said notches having a square opening of four notches equally spaced about its periphery and sized for engagement with the square nut or bolt, and a hexagonal opening of six notches of right angles with planar surfaces and engaging surfaces being separately sized for engagement with the hexagonal nuts or bolts at a maximum 5% difference of size to each other.

2 Claims, 6 Drawing Figures

WRENCH SOCKET

BACKGROUND OF THE INVENTION

"Do-it-yourself" handtools for family use require two sets of wrench sockets for driving fasteners, one set for square fasteners and another set for hexagonal fasteners. It would be desirable to provide a single wrench tool, such as a socket wrench or box end wrench, which would not only fit both a given square and a given hexagonal nut or bolt, but which would, in addition, provide a set of six notches for a hexagonal opening, with planar surfaces and engaging surfaces separately sized, to allow engagement with hexagonal nuts or bolts having a maximum 5% difference in size to each other.

SUMMARY OF THE INVENTION

This invention relates to a wrench socket driver, and more particularly to improvements in the notches at right angles which drive the head of a square or hexagonal nut or bolt. The wrench socket provides a peripherally closed socket defined by eight notches of the opening for reception of the driving head; said socket opening having a central axis adapted to be placed coincident with the nut axis about which it rotates, and including a square opening of four notches at right angles and sized for engagement with a square nut or bolt, and a hexagonal opening of six notches at right angles with planar and engaging surfaces sized for engagement with hexagonal nuts or bolts. The planar surface is defined at each end by a line extending from the axis of rotation, and intersects with an engaging surface which extends from the apex, and is flanked on adjacent sides by six notches at right angles, at a distance defined by a line extending from the said axis and forming an angle of the order of 10°, with another line extending from said axis through the notch, so that the socket opening provides eight notches at right angles for engagement with one square nut and two hexagonal nuts at a maximum 5% difference of size to each other, and both sizes of hexagonal nuts being within 115% of the size of the square nut.

DETAILED DESCRIPTION OF THE INVENTION

Figure 1:
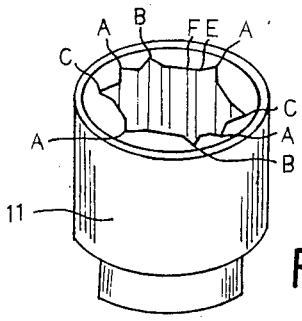
FIG. 1 is a perspective view of a wrench socket embodying the proposed design of this invention.

The invention relates to a wrench socket driver and more particularly to improvements in notches which will drive the head of a square or hexagonal nut or bolt. The wrench socket of the invention is exemplified in the drawing FIG. 1 as a socket wrench having a socket head (11) provided with a socket opening of eight peripheral notches of right angles with planar surfaces and engaging surfaces, which may be used of the head of other rotary drivers for driving square or hexagonal heads of nuts and bolts.

Figure 2:
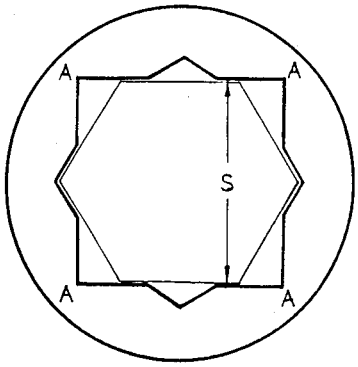
Fig. 2 (PRIOR ART)
FIG. 2 is an enlarged plan view of a socket wrench of the prior art for driving the head of a square or hexagonal nut or bolt of the same size.
Figure 3:
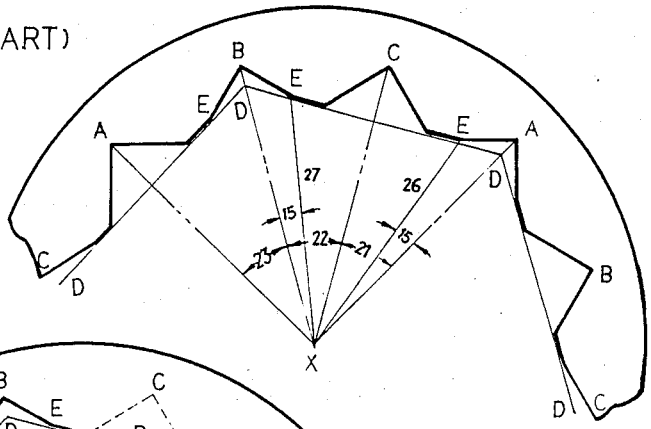
Fig. 3 (PRIOR ART)
FIG. 3 is an enlarged fragmentary plan view of a socket wrench of another prior art design illustrating the inner twelve peripheral notches at right angles divided equally for three sets of four notches having square openings and one set of six notches having hexagonal openings.

FIG. 2 is an enlarged plan view of a conventional 8-point socket wrench for driving square or hexagonal nuts or bolts which are both the same size. Referring to FIG. 3, the inner periphery of the opening of the socket has a central axis (X) adapted to be placed coincident with the nut axis about which it rotates, and has been divided equally by imaginary lines (XA), (XB) & (XC) extending from said central coincidental axes and forming angles (21), (22) & (23) with each other of the order of 30°, the said notches being so arranged at right angles and disposed relative to each other as to intersect, so as to form three sets of square openings of four notches at right angles and sized for engagement with the square nut or bolt. Lines (XA), (XB) & (XC) designate the respective maximum radial distances of the notches from the axis of rotation (X) of the notched opening, the radial distances being identical to each other. The socket opening of said twelve notches also includes a hexagonal opening adapted to be placed coincident with one set of six notches of right angles interposed between another set of six notches of right angles. The sides of the hexagonal openings are intersected with the adjacent sides of six notches at apexes (E) which are disposed on the sides of the square openings by a distance defined by lines (26) & (27) extending from the central coincidental axis (X) and forming angles (15) with the other line (XA) & (XB) extending from said axis (X) through said notches of the order of 10°.

Figure 4:
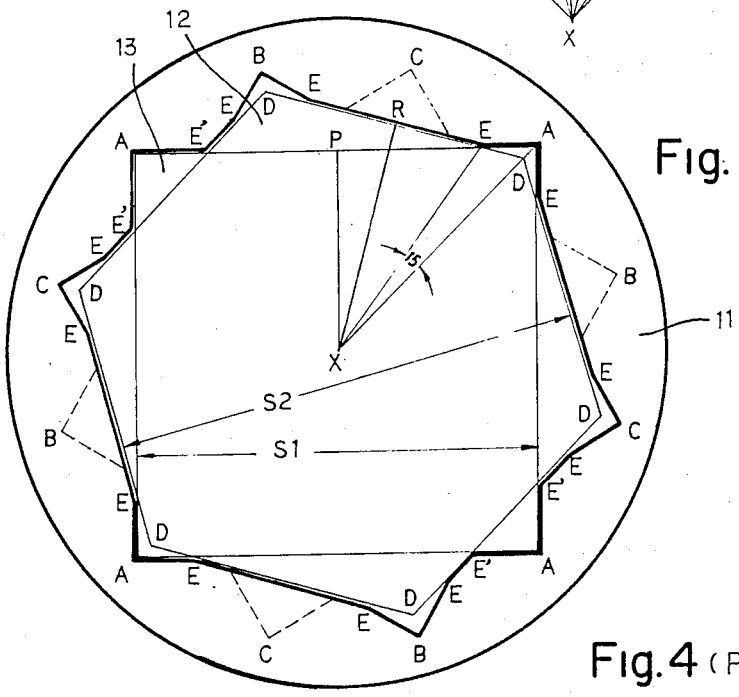
Fig. 4 (PRIOR ART)
FIG. 4 is an enlarged plan view of the socket in FIG. 3, with four notches removed, shown by dotted lines (BCBC).

Referring to FIG. 4, the notches (A) of square opening (13) are used for square head fasteners such as nuts or bolts having a width S1, the six-notches (ABCABC) of hexagonal opening (12) are used for hexagonal head fasteners (D) such as a nut or bolt housing a width S2, and the left 4 notches (BCBC) are removed as shown in FIG. 4, S1 and S2 referring respectively to the sizes of the driving head and of the notch openings represented by the socket head (11) which receives the driving head. It will be understood that some small clearance is ordinarily provided between the driving head of a nut or bolt and the socket, or other notched opening, which receives the driving head. FIG. 4 is an enlarged plan view, showing a hexagonal nut S2 in the notched opening (12) and a square nut S1 in the notched opening (13). Of importance to the present invention is the contact regions (AE) and (AE') between the square nut or bolt head and the socket or other notched opening. For example, assume that the desired square nut size S1 is 20 mm., thus (XP) is 10 mm., (AP) is 10 mm. and (XA) is 14.14 mm.. Angle (15) is in the order of 10°, (PE) is found to be (XP) tan 35° = 7.002 mm.. (XE) is (XP)/cos 35° = 12.207 mm., and (AE) is 2.998 mm.. (XR) is thus (XE) cos 20° = 11.4709 mm., (RE) is 4.1748 mm., thus the planar surface (EE) is 8.3496 mm.. The ratio (S2/S1) is about 115%, and the ratio referring to the hexagonal nut S2 is 15% larger than the square nut S1, which is 20 mm., while S2 is 22.9418 mm.. The desirable contact region between the wrench socket and the square nut, and the hexagonal nut S2 15% larger than square nut S1 are features embodied in all of these inventions and provides safe, operation within a 15% size difference.

Figure 5:
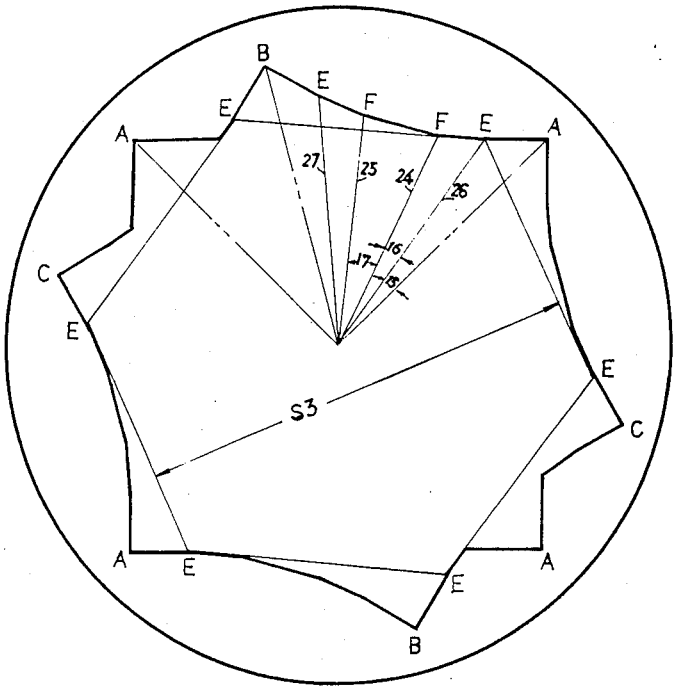
FIG. 5 is an enlarged plan view of the proposed wrench in FIG. 1, showing the planar surfaces and engaging surfaces in the hexagonal opening having six notches at right angles.

FIG. 5 is an enlarged plan view of the proposed design showing the planar surfaces (FF) and the engaging surfaces (EF) which replace the planar surfaces (EE) in FIG. 4. The engaging surfaces (EF) are increased from the apex (E) along the side of hexagonal head (E) of nut or bolt by a distance defined by lines (24) & (25) extending from the central coincidental axis (X) and forming an angle (16) of the order of 10° with another line (26) & (27) extending from said axis (X) through said apex (E), and the engaging surfaces (EF) are parallel to the side of hexagonal head (E) of nut or bolt and used for engagement with the hexagonal head fastener (E) of nut or bolt sized S3.

Figure 6:
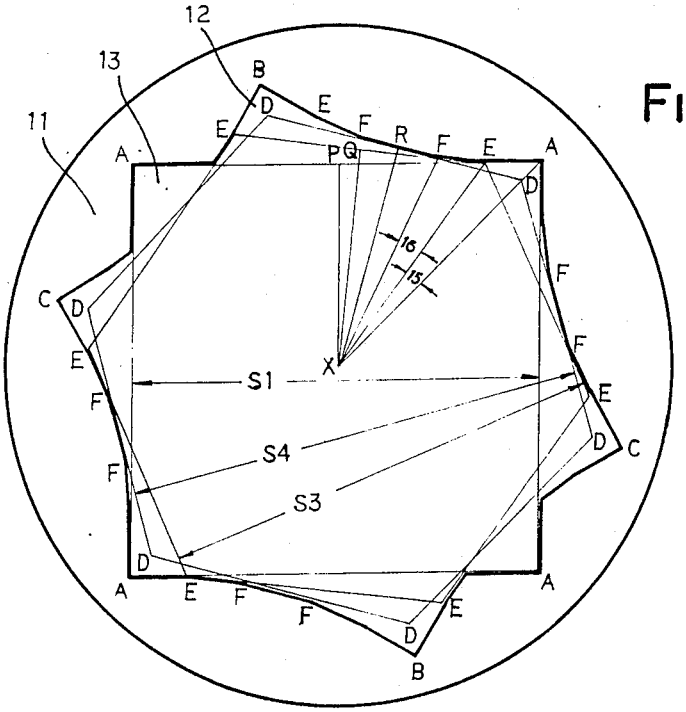
FIG. 6 is an enlarged plan view showing a nut S1 in the notched square opening (13) and nuts S3 & S4 in the notched hexagonal opening (12).

The planar surfaces (FF) are defined at each end by lines (24) & (25) and form an angle (17) of the order of 20° with each other, and used for engagement with the hexagonal head fastener such as a nut or bolt sized S4, as shown in FIG. 6, S3 and S4 referring respectively to the sizes of the driving head and of the hexagonal opening represented by the socket head (11) which receives the driving head. It will be understood that some small clearance is ordinarily provided between the driving head of a nut or bolt and the socket, or other notched opening, which receives the driving head.

FIG. 6 is an enlarged plan view of the proposed design showing a nut S1 in the notched square opening (13) and nuts S3 & S4 in the notched hexagonal opening (12). Of importance to this invention is also the contact regions AE, & EF & FF between the nut or bolt head and the socket or other notched opening. For example, assume that the desired nut S1 is 20 mm., thus (XP) is 10 mm., (AP) is 10 mm. and (XA) is 14.14 mm.. Angle (15) is in the order of 10°, (PE) is found to be (XP) tan 35°=7.002 mm., (XE) is (XP)/cos 35°=12.207 mm., and (AE) is 2.998 mm.. (XE) is 12.207 mm., thus (XQ) is (XE) cos 30°=10.5713 mm., and (EQ) is (XE) sin 30°=6.1035 mm.. Angle (16) is on the order of 10°, (XF) is found to be (XQ)/cos 20°=11.2497 mm., (FQ) thus is (XQ) tan 20°=3.848 mm and (EF) is 2.2555 mm.. Angle (17) is on the order of 20°, and (XF) is 11.2497 mm., thus (XR) is found to be (XF) cos 10°=11.0787 mm., and (FR) is (XF) sin 10°=1.953 mm., therefore, (FF) is 3.906 mm.. Thus the size of nut S3 is 21.14 mm., the size of nut S4 is 22.16 mm., and the engaging surface (EF) is 2.2555 mm., the planar surface (FF) is 3.906 mm. The ratio (S4/S3) is about 105%, and the ratio referring to the hexagonal nut S4 is 5% larger than the hexagonal nut S3, which is 21.14 mm., and S4, is 22.16 mm. The desirable contact regions of the wrench socket and the hexagonal nut S4, which is 5% larger than hexagonal nut S3, are features of all embodiments of this invention and provides safe, mar-free operation under 5% of size difference condition.

It is evident from FIGS. 5 and 6 that the invention accordingly provides a socket wrench for square and hexagonal fasteners having a peripheral socket wall formed by a first group of four notches A providing a square opening for receipt of a square fastener, a second group of four notches B, C which alternate with the notches A of the first group, three mutually angled planar engagement surfaces EF, FF, FE between each notch of the second group and one of the adjacent notches of the first group, and a further planar engagement surface starting on the other side of the respective notch at point E between the notch of the second group and the other adjacent notch A of the first group, the engagement surfaces defining alternative hexagonal openings for a pair of hexagonal fasteners having respective widths S3, S4 across their flats which are within 5% one to the other and within 15% larger than the widths S1 of the square fastener across its flats.

I claim:

1. A socket wrench for square and hexagonal fasteners having a peripheral socket wall formed by a first group of four notches providing a square opening for receipt of the square fastener, a second group of four notches which alternate with the notches of the first group, so that each notch of the second group is located between one and another adjacent notches of the first group, plural mutually angled contiguous planar engagement surfaces between each notch of the second group and said one of the adjacent notches of the first group, and a further planar engagement surface between each notch of the second group and said another adjacent notch of the first group, the engagement surfaces together defining means providing alternative hexagonal openings for a pair of hexagonal fasteners having respective widths across their flats which are within 5% one to the other and within 15% larger than the width of the square opening across its flats.

2. A socket wrench as defined in claim 1 wherein the plural planar engagement surfaces are three in number and each notch of the second group is asymmetrically located between the adjacent notches of the first group.

* * * * *